US006763645B2

(12) United States Patent
Hunter

(10) Patent No.: US 6,763,645 B2
(45) Date of Patent: Jul. 20, 2004

(54) PROTECTING BUILDING FRAMES FROM FIRE AND HEAT TO AVOID CATASTROPHIC FAILURE

(76) Inventor: Stanley F. Hunter, 104 Palin Ct., Latham, NY (US) 12110

( * ) Notice: Subject to any disclaimer, the term of this patent is extended or adjusted under 35 U.S.C. 154(b) by 0 days.

(21) Appl. No.: 10/249,879

(22) Filed: May 14, 2003

(65) Prior Publication Data

US 2003/0167721 A1 Sep. 11, 2003

(51) Int. Cl.[7] ..... F25B 29/00

(52) U.S. Cl. ..... 52/633; 52/1; 52/232; 52/2.17

(58) Field of Search ..... 52/1, 2.17, 2.21, 52/232, 633; 165/47, 53, 56, 50; 169/13, 16

(56) References Cited

U.S. PATENT DOCUMENTS 3,246,689 A * 4/1966 Remde et al. ..... 165/53
4,143,703 A * 3/1979 Creswick et al. ..... 165/48.1
4,203,487 A * 5/1980 Gartner ..... 165/50
5,988,264 A * 11/1999 Goldsmith ..... 165/48.1
6,029,404 A * 2/2000 Lewis ..... 52/2.18
6,637,159 B1 * 10/2003 Heath ..... 52/2.21

* cited by examiner

*Primary Examiner*—Carl D. Friedman
*Assistant Examiner*—Basil Katcheves
(74) *Attorney, Agent, or Firm*—Jay R. Yablon

(57) ABSTRACT

A system and related method for protecting a building frame from fire and heat to avoid catastrophic collapse, comprises a plurality of vertical structural members comprising substantially vacant interiors thereof; a plurality of horizontal structural members comprising substantially vacant interiors thereof; a plurality of attachments between ends of the horizontal structural members and side faces of the vertical structural members enabling a coolant to flow between the interiors of the vertical structural members and the interiors of the horizontal structural members; a plurality of coolant pumps for pumping the coolant into the vertical structural members; a plurality of heat release valves for emitting the coolant from the interiors of the vertical structural members and the interiors of the horizontal structural members when a temperature of the coolant reaches a predetermined temperature threshold.

49 Claims, 3 Drawing Sheets

PROTECTING BUILDING FRAMES FROM FIRE AND HEAT TO AVOID CATASTROPHIC FAILURE

BACKGROUND OF INVENTION

This invention relates generally to building construction, and in particular to constructing tall building frames in a manner that avoids weakening of the building frame and possible collapse of the building in the event of a serious fire.

On Sep. 11, 2001, it is estimated that as many lives were lost from the collapse of the World Trade Center as from the fire and explosion preceding the collapse, including the lives of many New York City police and firefighters. It is also understood that high heat from the blaze raised the temperature of the Trade Center towers' steel framing close enough to the melting point of steel to bring about catastrophic failure resulting in the building's collapse.

Tall building frames, comprising a network of interconnected vertical and horizontal structural members often referred to as (vertical) columns and (horizontal) beams, are today protected from high heat if at all merely with conventional static insulation. Unfortunately, such static insulation can only protect the structure for a limited period of time, and certainly does not enable a building to withstand collapse under high heat indefinitely. And, over time, this insulation is prone to wearing off, loss, and deterioration, thereby losing entirely even the limited protection that such insulation provides. For example, a recent article posted at the National Science Foundation's web site shows a pre-disaster photograph of one of the south tower's columns, with much of its fireproofing material peeled off. This same article observed that it would be desirable "to require fireproofing that would enable a skyscraper to withstand complete burnout of its contents without collapsing." This is an important goal; the question, of course, is how to achieve this.

Under the conditions which transpired at the World Trade Center on Sep. 11, 2001, passive insulation, such as disclosed in U.S. Pat. Nos. 4,220,685 and 4,723,385, simply will not provide indefinite protection against collapse, but will merely gain a small increase in the time until collapse. The former patent discloses a thin protective foil fastened to the face of a structure to be protected, and under high heat, thermal expansion creates a "blister" which results in an air space which thermally insulates the structure. This benefit would be very short-lived under World Trade Center conditions. The latter patent discloses a phase-conversion material with a water content such that when heated sufficiently, the phase conversion material releases its water content in the form a vapor. This will provide cooling, but only for a very limited time insufficient to avert collapse. U.S. Pat. No. 4,304,082, while not for protection in a fire, similarly to U.S. Pat. No. 4,220,685, also creates an air space to provide insulation.

If one wishes to "enable a skyscraper to withstand complete burnout of its contents without collapsing" as set forth above, passive insulation alone will not suffice. Some form of heat exchange (or more precisely, heat removal) system will be required so that heat buildup is removed from the building framing on a continuous basis, indefinitely, until the fire has burned itself out or been extinguished. The heat exchange system itself must be suitably protected and redundant, so that in the event part of that system is physically disabled for example by an explosion such as occurred when the airliners ripped through the Trade Center towers at their initial impact, the remainder of the system will remain operational and compensate for those parts of the system which no longer work.

Heat exchange, of course, is a well established means of cooling or heating as the case may be. Indeed, an entire U.S. patent classification, class 165, has been established strictly for heat exchange. In many instances, heat exchange is used to regulate the temperature of an indoor space so that people inside remain comfortable, such as various forms of heating or air conditioning. Refrigeration, of course, utilizes circulation of a fluid with high specific heat to both cool down the refrigerated space and carry away excess heat from that space.

But, for a situation such as occurred on Sep. 11, 2001, one needs to remove massive amounts of heat, not merely to regulate a temperature within a small temperature zone or refrigerate a limited space. More appropriate to consider as pertinent background, for example, are U.S. Pat. Nos. 3,995,687 and 4,301,320 which relate to cooling of a furnace, or the many patents relating to cooling of the core in a nuclear facility, such as U.S. Pat. Nos. 3,854,524; 3,866,424; 3,935,063; 4,038,134; 4,051,892; 4,560,533; 4,698,201; 5,229,067; 5,319,688; and 5,579,355; as well as disclosure document H119. Also of background interest is U.S. Pat. No. 5,195,575 which appears to be a somewhat general purpose heat tube.

Even in these situations, however, one simply does not encounter the massive scale of a structure such as the World Trade Center Towers with over 100 floors and a huge footprint, or even a much smaller structure of, say ten to sixty floors with perhaps a smaller footprint which still presents a formidable heat exchange challenge. In all these situations, the removal through heat exchange of the massive amounts of heat that would be generated in a situation such as occurred at the World Trade Center is not a trivial undertaking, and the specific solutions to achieve such an objective are not at all apparent or obvious.

SUMMARY OF INVENTION

A system and related method for protecting a building frame from fire and heat to avoid catastrophic collapse, comprises a plurality of vertical structural members comprising substantially vacant interiors thereof; a plurality of horizontal structural members comprising substantially vacant interiors thereof; a plurality of attachments between ends of the horizontal structural members and side faces of the vertical structural members enabling a coolant to flow between the interiors of the vertical structural members and the interiors of the horizontal structural members; a plurality of coolant pumps for pumping the coolant into the vertical structural members; a plurality of heat release valves for emitting the coolant from the interiors of the vertical structural members and the interiors of the horizontal structural members when a temperature of the coolant reaches a predetermined temperature threshold.

BRIEF DESCRIPTION OF DRAWINGS

The features of the invention believed to be novel are set forth in the appended claims. The invention, however, together with further objects and advantages thereof, may best be understood by reference to the following description taken in conjunction with the accompanying drawing(s) as summarized below.

DETAILED DESCRIPTION

Figure 1:
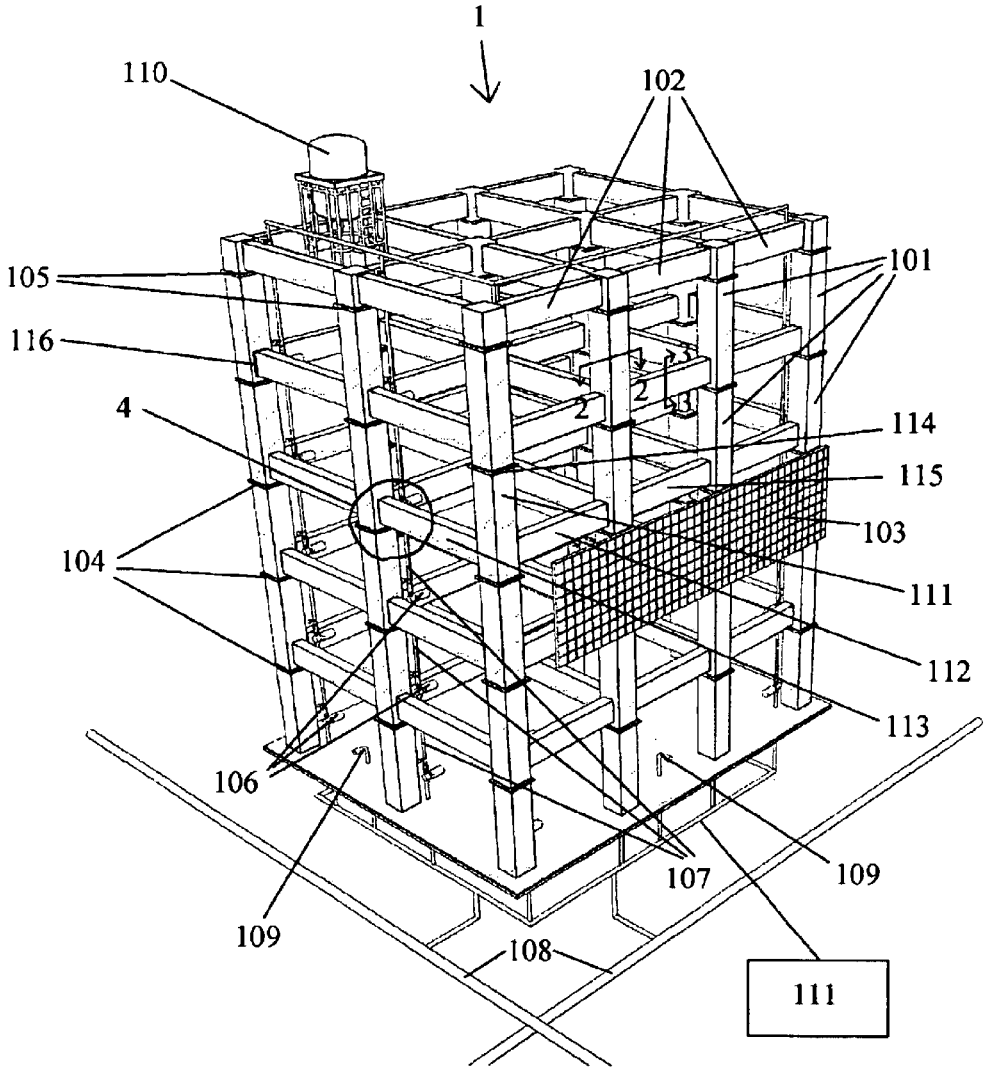
FIG. 1 is a perspective view illustrating a building frame in accordance with a preferred embodiment of the invention.

As used herein, the term "building frame" will be used to refer to the primary load-bearing structure of a building, i.e., that part of a building structure which provides primary physical support and structural integrity to carry the weight of the building and all of its contents with suitable strength and without collapse under a range of stresses including weight, wind, earthquake, etc. Virtually all other parts of the building are connected to and supported by this frame, directly or indirectly.

As used herein, "vertical structural member" will be used to refer to those elongated members of a building frame which are primarily vertically oriented. Such vertical structural members are also commonly referred to as "columns." Similarly, "horizontal structural member" will be used to refer to those elongated members of a building frame which are primarily horizontally oriented. Such horizontal structural members are commonly referred to as "beams." Such structural members typically comprise frame member materials such as steel, iron, or a similar very strong metal. It is understood that with advances in materials science, frame member materials may be developed which do not exist today which will be suitable for replacing presently-known frame member materials in accordance with this invention, within the scope of this disclosure and its associated claims.

In a preferred embodiment of the invention, the frame of a building comprises structural members which are substantially hollow (vacant) in their interior, such as but not limited to so-called "box" beams and "box" columns widely known and used in the art. What is important is that these beams and columns comprise an enclosed, substantially vacant interior which can be filled with large quantities of a coolant, preferably ordinary water due to its relatively low cost compared with other possible coolants, its environmental safety, and its universal availability. Thus, for example, so-called "I-beams" would not be suitable for use in connection with this invention, since they to not comprise any interior region which can be filled with coolant. Because building frames typically comprise frame member materials such as steel, iron, or a similar strong metal which is very heat conductive, the structural members of the frame will maintain a fairly close thermal equilibrium with the coolant which fills them and will transfer heat very rapidly to the coolant, which is desirable. Indeed, with all other factors being equal (e.g., strength, cost, weight, weakening temperature, etc.), frame member materials which are highly heat conductive are preferable over frame member materials with a lower heat conductivity.

A network of pipes, pumps, valves; gauges, detectors, and controls to be described in further detail herein is used to fill the structural members of the frame with coolant, and to maintain the structural members in a substantially-filled state at all times. In the event of a fire, this same network of pipes, pumps, valves, gauges, detectors and controls serves to "exchange" (release) heat accumulated in the coolant by venting off coolant that has been heated and turned into a gas phase by the fire in the case of a water coolant, by venting off steam. The coolant that has been vented off is replaced with a fresh supply of replacement coolant, so that the structural members are always filled with coolant and always maintained well below their weakening temperature.

Water, as stated earlier, is the preferred coolant, but is not limiting as regards this disclosure and its associated claims. Water's latent heat of vaporization is 970 BTU's per pound, which enables it to remove a tremendous amount of heat from the steel, iron, or a similar frame material. In contrast, it only takes 0.2 BTU's to raise one pound of steel one degree F. Because a water coolant in liquid phase inside the structural members cannot exceed its boiling point for a particular pressure, e.g., 212° F. at sea level pressure, this means that even in the hottest fires, the structural members of the frame, maintaining a fairly close thermal equilibrium with the coolant, will not be rise to a temperature much beyond approximately 212° F. This is far below the failure point of the steel or any other material that might be used for framing. As a result, catastrophic collapse can be avoided indefinitely, regardless of the severity of the fire. The vented steam, as a side benefit, may also be used to suppress the fire if the steam vapor is transported proximate the site of the flames.

FIG. 1 illustrates a building frame 1 in a preferred embodiment of the invention. In high rise construction, successive floors are typically separated from one another by ten or perhaps twelve feet. We shall presume that floors are ten feet apart strictly for purposes of discussion and estimation, without this imposing any limitation on the actual floor separation for a particular building construction. Building frame 1 comprises a plurality of vertical structural members 101, e.g., column members, and a plurality of horizontal structural members 102, e.g., beam members, typically interconnected with one another in a three-dimensional lattice structure, substantially as shown. It is understood that architectures among building structures can and do vary such that the interconnections of column and beam members will also vary somewhat. So the particular type of lattice shown in FIG. 1 is intended to be illustrative, not limiting. Vertical structural members 101 are typically fabricated in elongated sections of perhaps 100 feet long, and welded together end-to-end to construct the entire column from underground to ground to roof level, but again, this supposition of 100-foot column sections is for illustration and not limiting. Horizontal structural members 102 normally run from column to column, and are typically perhaps 50 feet in length. Again, the supposition of 50-foot beam members is for illustration and not limiting. Note, with the above illustrative suppositions, that FIG. 1 is not drawn to scale as between horizontal and vertical dimensions.

Thus, with these illustrative, not limiting numbers, FIG. 1 illustrates a 4×3 matrix of twelve columns (most readily seen when looking down toward the roof). Each column comprises vertical structural members 101 of 100 feet each. Thus, the height of this illustrative building frame 1 is 500 feet. The wide face of this building frame 1 is 150 feet, and its narrower face is 100 feet. A section of windows 103 is added merely for illustration, showing nine floors over a 100 foot vertical rise through one vertical structural member 101. This would suggest a height of about 11.1 feet per floor, but again, for round numbers, we shall work on the illustrative supposition of ten feet per floor, ten floors per vertical structural member 10, thus vertical structural members 10 of 100 feet each.

Figure 2:
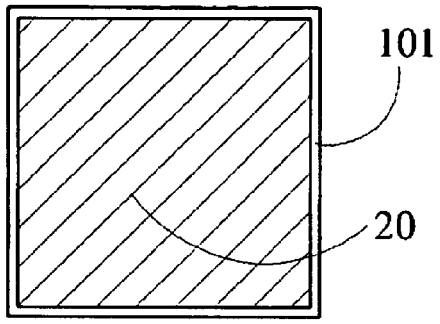
FIG. 2 is a cross-sectional view illustrating a vertical structural member of the building frame in the preferred embodiment.
Figure 3:
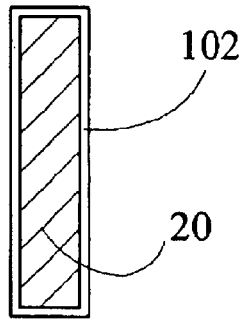
FIG. 3 is a cross-sectional view illustrating a horizontal structural member of the building frame in the preferred embodiment.

As noted earlier, vertical structural members 101 and horizontal structural members 102 are of the "box" column and beam variety, which is to say that they each comprise a substantially hollow (vacant) interior suitable for containing coolant. This does not imply that these structural members are limited by this disclosure or its associated claims to comprising a square or rectangular cross section, although in most cases they likely will comprise a square or rectangular cross section. FIG. 2 illustrates a cross section of vertical structural member 101 taken along the line 22 of FIG. 1. FIG. 3 illustrates a cross section of horizontal structural member 102 taken along the line 33 of FIG. 1. The substantially-vacant interiors of vertical structural member 101 and horizontal structural member 102 are each filled with a coolant 20 shown in diagonal shading, preferably water, which provides the basis for the release of heat in accordance with the invention. A box column or box beam typically comprises steel of about 1 to 2 inches in thickness, though this disclosure is not limited in any way by the thickness of the steel chosen. Again, what is critical is that the steel whatever its thickness must have the ability to be filled with a coolant and then maintain that coolant in its substantially vacant interior section. And, as noted above, high heat conductivity is desirable.

We now turn to the specifics of how this is all achieved.

Figure 4:
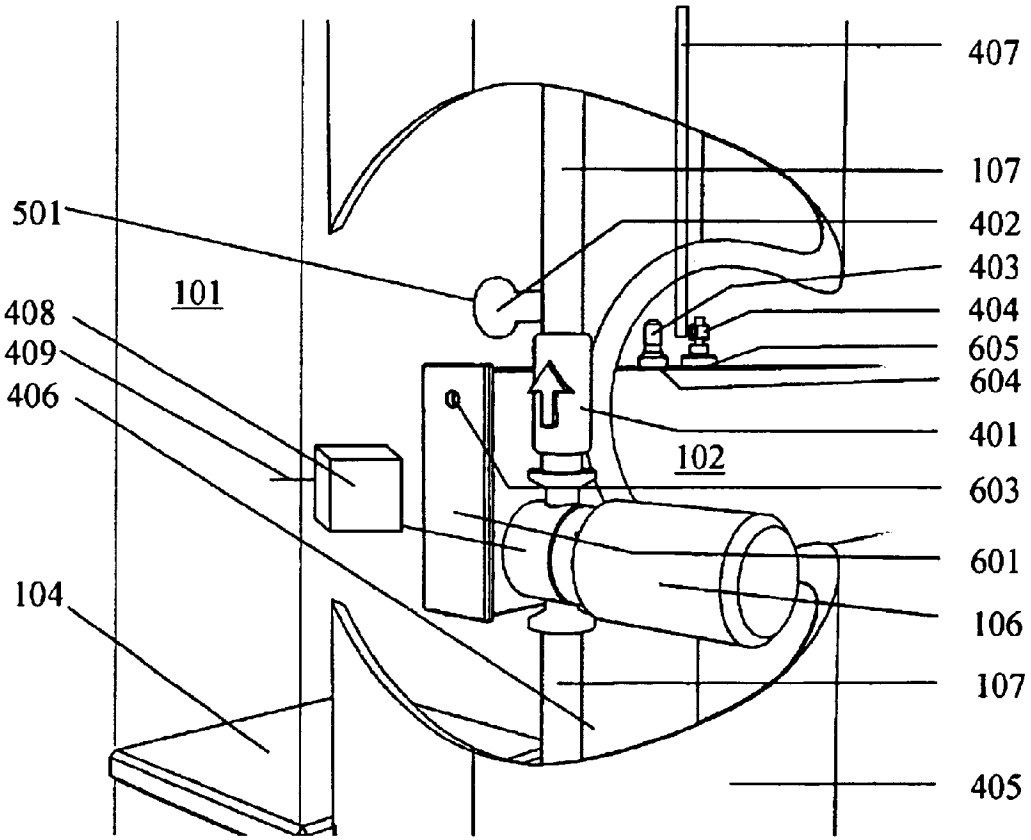
FIG. 4 illustrates the pumping, plumbing, heat release, isolating, detection, and related components which provide the operational foundation of the preferred embodiment.

Turning back to FIG. 1, and also to the encircled region 4 in FIG. 1 which is shown in detail in FIG. 4, we first note that an isolating plate 104, 105 resides at the juncture between the vertical structural members 101 in any given column, and in particular, at the bottom of each vertical structural member 101. The top tier of pumps and isolating plates 105 nearest the roof is optional, and may be omitted. These isolating plates 104, 105, comprise substantially planar solid steel or similar-material plates, and are attached at to the bottoms of vertical structural members 101. Although isolating plates 104, 105 are shown protruding slightly from (with a slightly larger width than) vertical structural members 101, this is mainly for illustration. Preferably, they are substantially flush.

Preferably, vertical structural members 101 are fabricated integrally comprising isolating plates 104, 105, so that vertical structural members 101 essentially comprise an elongated six-sided structure with five of the six faces (four sides, one bottom) closed and the sixth (top) face open. This is illustrated with shading in FIG. 5. Note again that the "box" shape is merely illustrative, not limiting, and that something other than a four-sided member, even if not common, would still fall within the scope of this disclosure and its associated claims. Alternatively, vertical structural members 101 may be fabricated as a conventional box column with the four vertical faces all closed and the two end (top and bottom faces) open, and with a distinctly-fabricated isolating plate 104, 105 welded or attached by similar attachment means to the bottom face.

Figure 5:
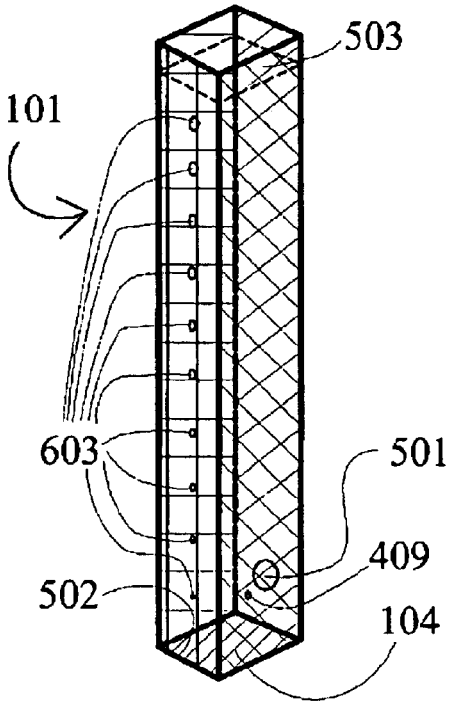
FIG. 5 is a perspective view illustrating a vertical structural member of the building frame in the preferred embodiment.

Whether integral fabrication or attachment separate from fabrication is employed, it is important that isolating plates 104, 105 be fully and securely attached to vertical structural members 101, because the vertical structural member 101 and isolating plate 104 combination of FIG. 5 will ultimately be filled with a very large quantity of coolant 20 and it is of course desirable that there be no leakage at the juncture between vertical structural member 101 and isolating plate 104. This juncture is thus preferably supplemented with a durable watertight sealing means 502 for preventing such leakage such as a sealant, an "o" ring, or similar watertight sealing means. Preferably, the watertight sealing means is situated inside the vertical structural member 101 so that coolant pressure will make the watertight seal more rather than less secure.

Vertical structural member 101 further comprises a coolant entry port 501, preferably proximate its lower end as illustrated. However, coolant entry port 501 may be positioned at any height desired along the surface of vertical structural member 101 within the scope of this disclosure and its associated claims. Coolant 20 is pumped into the vertical structural member 101 and isolating plate 104 combination of FIG. 5 through coolant entry port 501, using coolant pumps 106 such as shown in detail in FIG. 4, in the manner to be discussed shortly.

Isolating plate 104 (and optional 105 just below roof level) serves two main functions. First of all, in ordinary operation, it reduces the water pressure requirements for coolant pumps 106 which are used to pump coolant 20 into vertical structural member 101. Consider the following: A 2.3 foot high column of water produces one p.s.i. at the bottom of the column. To simplify calculation, we shall round this to approximate that every two feet of water in the column produces one p.s.i. of water pressure. Thus, absent isolating plate 104, 105, if one were to fill an entire 500 foot column in the illustrative building of FIG. 1 with water, the pressure at the bottom of the column would be approximately 250 p.s.i. Thus, a single coolant pump at the bottom of this 500 foot column would need to pump in the coolant using over 250 p.s.i. of pressure. By using a series of isolating plates, as well as a coolant pump 106 proximate the bottom of each vertical structural member 101 and isolating plate 104 combination of FIG. 5, the pressure at the bottom of each 100-foot vertical structural member 101 will only be about 50 p.s.i. This puts less pressure on the steel, and it allows the vertical structural member 101 to be filled using only a 50 p.s.i. coolant pump 106. However, it is preferred for each pump to produce at least twice the pressure necessary to fill the column, e.g., at least 100 p.s.i. in this illustrative example, so that if the next higher coolant pump 106 should become inoperative for any reason, the lower coolant pump 106 will have the capability to pump coolant 20 not only into its own vertical structural member 101 and isolating plate 104 combination, but also into the next-higher vertical structural member 101 and isolating plate 104 combination. For sake of discussion, without limitation, we shall suppose that coolant pumps 106 are in fact rated at about 125 p.s.i., which can pump coolant up through about 250 feet of column, or through the height of approximately 2.5 vertical structural members 101.

Second, under disaster conditions, as will be seen in detail later, isolating plate 104 segments the column so that if one vertical structural member 101 should rupture (such as in the World Trade Center from an airplane or in other conceivable circumstances such as from a bomb or even an unintentional explosion), the system will continue to operate for those vertical structural members 101 which have not been ruptured.

FIG. 4 provides further operational detail about the overall pumping system. Running astride and proximate the outside of each building column is a coolant conduit 107, which comprises a plumbing pipe of suitable thickness. Generally, coolant conduit 107 should be sized and rated to readily handle pressures from 125 up to 300 p.s.i. Coolant pump 106 is connected in line with the coolant conduit 107 as illustrated in FIG. 4, so as to pump water upward at a pressure of at least 50 p.s.i. for the given illustration, but as noted earlier, preferably at a (double) pressure of at least 100 p.s.i., and for this discussion, at 125 p.s.i. A check valve 401 just above each coolant pump 106 permits flow only in the upward direction, and blocks any downward flow of coolant. This establishes a gravitational ground for the coolant conduit 107 between any two vertically-adjacent coolant pumps 106, and in combination with isolating plates 104, 105, is what enables the system to operate such that only 50 p.s.i. is needed for each coolant pumps 10 to pump coolant up to the level of the next-higher pump. That is, check valves 401 serve the same function vis-Ã-vis coolant conduits 107 that isolating plates 104, 105 serve vis-Ã-vis vertical structural members 101, namely, creating a series of gravitational "grounds" so that the pressures needed to boost coolant from one level up to the next are reduced, and so that the coolant 20 pressures within the overall system are also reduced and more evenly distributed. A coolant injection conduit 402 flows coolant 20 from coolant conduit 107 through coolant entry port 501 into the interior region of vertical structural member 101.

Figure 6:
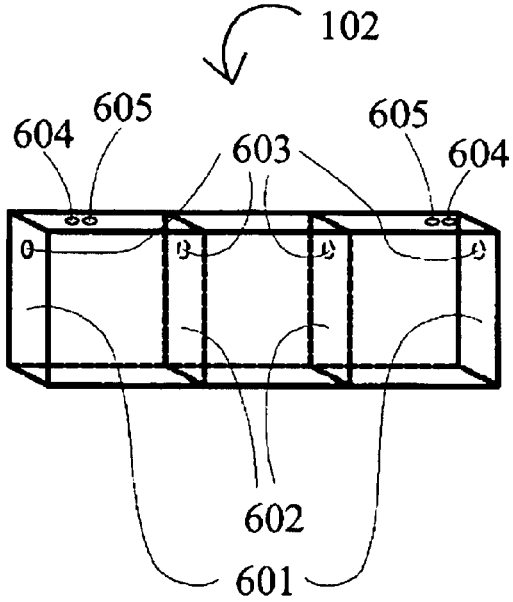
FIG. 6 is a perspective view illustrating a horizontal structural member of the building frame in the preferred embodiment.

Let us turn now to the horizontal structural members 102, illustrated in FIG. 6, commonly referred to as beams. As noted earlier in connection with FIG. 3, these beams are also of the "box" beam variety, that is, they also have a substantially vacant interior surrounded by side faces comprising frame member materials, and are filled with coolant 20. However, each horizontal structural member 102, proximate its two ends, comprises a pair of flow limiting end-plates 601, as well as one or more optional flow-limiting mid-plates 602. Preferably, horizontal structural members 102 are fabricated integrally comprising flow limiting end-plates 601. Alternatively, horizontal structural member 102 may be fabricated as a conventional box beam with distinctly-fabricated flow limiting end-plates 601 welded or attached by similar means to its ends. As will be discussed, for "surface butt weld" construction, flow limiting end-plates 601 may be omitted because their function is subsumed by an outer face of a vertical structural member 101.

Each flow limiting end-plate 601 and each flow-limiting mid-plate 602 comprises a flow-limiting aperture 603. Each horizontal structural member 102 also comprises at least one air vent aperture 604, and at least one heat release aperture 605, though it is possible that air vent aperture 604 and heat release aperture 605 can be merged into a single aperture in special circumstances as discussed below. FIG. 6 illustrates two such air vent apertures 604 and two such heat release apertures 605, located proximate each of the two ends of horizontal structural member 102. However, these air vent apertures 604 and heat release apertures 605 may be placed anywhere along horizontal structural member 102, and the number of these employed, as well as their locations, is not limited, and is determined by the overall heat exchange configuration specified for a given building. As shown in FIG. 4, an air vent and coolant retention assembly 403 is attached to employ each air vent aperture 604, and a heat release valve 404 is attached to employ each heat release aperture 605. Preferably, air vent and coolant retention assembly 403 and heat release valve 404 will comprise stainless steel for optimum durability against high temperature.

Similarly to the how the isolating plates 104, 105 are connected with vertical structural members 101, horizontal structural members 102 are preferably fabricated integrally with flow limiting end-plates 601. The protrusion in FIG. 4 is for emphasis, but is unnecessary, i.e., flow limiting end-plates 601 are preferably flush with horizontal structural members 102 as shown in FIG. 6. Thus, horizontal structural members 102 also comprise a six-sided structure, but in this case, all six faces are closed except for the flow-limiting apertures 603, the air vent apertures 604, and the heat release apertures 605. While flow limiting end-plates 601 are preferably fabricated with horizontal structural members 102, they can alternatively be fully and securely attached to horizontal structural members 102 after steel fabrication, using welding or a variety of suitable similar attachment means, in a manner that avoids leakage.

In customary building construction practice, when a horizontal structural member 102, e.g., beam is connected into a vertical structural member 101, it is preferred to punch a hole in the side of vertical structural member 101 which closely matches the cross section of horizontal structural member 102 (e.g., 1 foot by 4 feet, see FIG. 3). Horizontal structural member 102 is then inserted into this hole, and the juncture is then welded together. This is commonly referred to as "punch and weld." Less preferable, but still within the scope of this disclosure and its associated claims, is a so-called "surface butt weld" in which horizontal structural member 102 is attached using suitable attachment means (e.g., welded) to the outer face of vertical structural member 101 without any hole punch. Where a surface butt weld is employed the special case noted earlier horizontal structural member 102 need not comprise flow limiting end-plates 601, that is, flow limiting end-plates 601 may be omitted from FIG. 6. Instead, as shown in FIG. 5, flow-limiting apertures 603 (ten of these, successively larger higher up for reasons that will become apparent shortly) are punched directly into the side of vertical structural member 101, and then horizontal structural member 102, open at its end, is surface butt welded over this flow-limiting aperture 603 to achieve substantially the configuration shown in FIG. 4 of flow-limiting aperture 603 relative to horizontal structural member 102, with a clean weld at the juncture of vertical structural member 101 with horizontal structural member 102 to avoid any coolant leakage. As was the case noted earlier for the isolating plates 104, 105, it is of course desirable that there be no leakage at the juncture between vertical structural member 101 and horizontal structural member 102. This juncture too is preferably supplemented with a durable watertight sealing means 116 for preventing such leakage, such as a sealant, an "o" ring, etc. For purposes of the discussion to follow, we will assume that horizontal structural member 102 is connected into vertical structural member 101 using the preferred "punch and weld" methodology.

No matter what the methodology used to attach horizontal structural member 102 to vertical structural member 101, this attachment is performed such that there is a flow-limiting aperture 603 between horizontal structural member 102 and vertical structural member 101 as shown in FIG. 4, such that coolant 20 is able to flow freely, but at a flow rate limited by the dimension (e.g., diameter) of flow-limiting aperture 603, between vertical structural member 101 and horizontal structural member 102. As a result, coolant 20 introduced into vertical structural member 101 as earlier discussed, via coolant injection conduit 402, will flow into and fill horizontal structural member 102 via flow limiting aperture 603. Thus, the means are in place such that the whole building frame both horizontal and vertical components may be filled with coolant 20.

It is noted that although we have spoken of the frame as if it comprises only horizontal and vertical structural members, it is understood that there may also be frame members which are neither horizontal nor vertical, but which have some diagonal component. To the extent that such diagonal elements are attached to some part of building frame 1, these too may be filled with coolant in the manner discussed, and those aspects of this disclosure which refer primarily to horizontal and vertical framing members should be regarded as illustrative, not limiting. Similarly, heavy duty and light weight trusses will be installed in the same manner as horizontal structural member 102, e.g., beams. All the trusses components are also substantially vacant with interiors interconnected by suitable flow-limiting apertures 603 so that these may also contain coolant 20 interconnected with the overall system.

Also illustrated in FIG. 4 is an insulating shield 405—shown partially cut away for illustration—surrounding coolant pumps 106, coolant conduits 107; check valves 401, and indeed all of the plumbing and electrical components that are used to feed coolant 12 into vertical structural member 101. Insulating shield 405 encloses these plumbing and electrical components along the entire height of the building columns in a cooling envelope 406. Air within cooling envelope 406 is cooled by close proximity to vertical structural member 101. Because the steel or similar material comprising vertical structural member 101 has a high thermal conductivity, the coolant inside vertical structural member 101 serves during a fire to cool the cooling envelope 406 space between insulating shield 405 and vertical structural member 101 and thus maintain these plumbing and electrical components close to the maximum temperature of the coolant, namely, about 212° F. Thus, so long as the various plumbing and electrical components are capable of withstanding temperatures near the boiling point of water which is highly feasible with known pumps, electrical components, and plumbing components the system components detailed in FIG. 4 will remain intact and continue to cool building frame 1 during a fire, which, of course, is the primary goal of the invention. Additional insulating protection may be provided for individual components, for example, the coolant pumps 106 or related electrical components, along the lines disclosed, for example, in U.S. Pat. No. 4,307,813.

Coolant 20, preferably water in a preferred embodiment, is initially fed into the system in one or both of two ways. First, referring to FIG. 1, an ordinary public water supply 108 (shown underground and thus isolated from any fire in the main building in this illustration) feeds water into the system as shown, and is plumbed into the system as illustrated, to be pumped in an upward direction using coolant pumps 106 as discussed previously. Second, one or more external hose connections 109 may be provided and plumbed into the system as illustrated. In the event that the public water supply 108 is cut off for some reason, and/or to supplement water volume and/or water pressure from the public water supply 108, fire department equipment (e.g., water supplies and hoses) may be attached to external hose connections 109 to provide additional water and/or water pressure into the system.

Finally, atop the building is roof storage containment 110. Roof storage containment 110 contains water used for the building's conventional fire sprinkler system to be used in the event of a fire. In the system herein disclosed, the plumbing used to pump water into the building frame may also be plumbed into storage containment 110 for filling storage containment 110, so that one plumbing network serves both purposes. Also illustrated is a monitoring and control module 111 which is electronically tied in throughout the whole system, with suitable wiring and/or remote control. Monitoring and control module 111 is used to manually monitor pumps, pressures, temperatures, and other system variables to ensure that the system is working properly, and to determine which parts of the system have become inoperative, both in normal use, and in an emergency. It is also used to manually control operation of the system, for example, to turn various pumps on and off manually as needed. Note that the various pumps and other system components are normally run automatically, but can be manually overridden, as desired.

At this point, having reviewed each of the primary system components and their basic interrelationships, we turn to examine the overall operation of the system. First, we consider the initial steps of "charging" the system, that is, filling the building frame with coolant after the frame has been fully constructed. Second, we consider the ordinary day-to-day operation of this system. Finally, we consider the operation of this system in the event of a fire and/or explosion.

We first note that FIG. 1 does not illustrate isolating plates 104 or horizontal structural members 102 at the lowest level. This is merely for purposes of drawing simplicity; but in a real framing construction, there would in fact be both isolating plates 104 and horizontal structural members 102 proximate the ground floor. Note also that in most constructions there are typically several horizontal structural members 102 connected, one for each floor, to a single vertical structural member 101, whereas FIG. 1 illustrates only one horizontal structural member 102 for each ten-floor vertical structural member 101, again, for drawing simplicity. In reality, to a vertical structural member 101 spanning ten floors, there would be connected ten horizontal structural members 102, one per floor. Thus, in this illustration, FIG. 1 should be understood to convey that ten horizontal structural members 102 for floors 1 through 10 are affixed to adjacent pairs of lowest-level vertical structural members 101, for floors 11 through 20 to the second-level vertical structural members 101, for floors 21–30 to the third-level vertical structural members 101, and so on.

Earlier, it was mentioned that horizontal structural members 102 comprise air vent apertures 604 as well as air vent and coolant retention assemblies 403 employing these air vent apertures 604. It was also mentioned that horizontal structural members 102 comprise heat release apertures 605 as well as heat release valves 404 employing these heat release apertures 605. It was also mentioned that horizontal structural members 102 are attached to vertical structural member 101 so that coolant 20 may flow between vertical structural member 101 and horizontal structural member 102 via flow-limiting aperture 603.

To "charge" an empty building frame 1, the flow of coolant 20 into the system is activated. In the event that the public water supply 108 is used, this water supply is activated to flow water into the system. One or all of the lowest-level pumps are activated (although if the water supply pressure is high enough, lower-level coolant pumps 106 need not be activated). Coolant 20 is pumped into the lowest-level vertical structural members 101 via their coolant injection conduits 402. As coolant 20 begins to fill the lowest-level vertical structural members 101 grounded by the lowest-level isolating plates 104, the water will rise to a level where it will begin to flow naturally through flow-limiting apertures 603 into horizontal structural members 102. This is where air vent and coolant retention assemblies 403 come into play. Because the building frame 1 should be welded together to be air-tight and water-tight, it would not be possible to fill the frame with water unless there is some way to purge the air that initially occupies the frame. Otherwise, the air pressure would build to such a high degree that water could no longer be introduced. Thus, air vent and coolant retention assemblies 403 are used to bleed off the air as building frame 1 is filled with coolant. On the other hand, once the frame has been filled, it is of course desirable not to leak out any of the coolant. Thus, air vent and coolant retention assemblies 403 also need to close off and provide a back pressure blocking the outflow (exit) of coolant once the frame has been filled, thereby retaining the coolant 20. It is possible for air vent and coolant retention assemblies 403 to comprise a configuration as simple as a float valve similar to that in a toilet tank coupled with air vent apertures 604, wherein the float valve automatically rises to as air is discharged to block off its associated air vent aperture 604. Air vent and coolant retention assemblies 403 may also comprise, for example, air vent and coolant retention valves serving this same function of venting air and retaining (checking) coolant.

Once the lowest level horizontal structural member 102 has been filled, air vent and coolant retention assemblies 403 will close to bar the further exit of coolant 20 from this the lowest level horizontal structural member 102. The back pressure through flow-limiting aperture 603 into vertical structural members 101 will then cause coolant 20 being fed into vertical structural members 101 to rise now to the next higher (i.e., second floor) horizontal structural members 102. Once the coolant reaches the second floor level, it will flow via flow-limiting apertures 603 into the second floor horizontal structural members 102. These will fill with coolant 20 while venting air through their air vent and coolant retention assemblies 403. Then their air vent and coolant retention assemblies 403 will close off the outflow of coolant 20, and filing will proceed to the third floor level, and higher levels, in an iterative process. Once the highest level is filled for a given level of vertical structural members 101 (e.g., floor ten in this illustration), there is no more opportunity for air to bleed out under pressure. Thus, one may conclude that an air vent and coolant retention assembly 403 ought to be provided at the very top of each vertical structural member 101 so that each such vertical structural member 101 can be filled right to its very top. However, because coolant, e.g. water is incompressible and air is very compressible, it is actually preferable to maintain a small air cushion at the top of each vertical structural member 101. If the system was filled entirely with coolant 20, then changes in coolant pressure due to changes in coolant temperature would be more pronounced, whereas the air pocket minimizes pressure changes due to temperature changes. To prevent pumps from short cycling it is preferable to minimize pressure swings. Thus, a small pressurized air cushion shown in the region designated 503 in FIG. 5, up to approximately one or two or three or four or five or six or seven or eight or nine or ten or eleven or twelve feet in height but no more than the height between floors is maintained at the top of each vertical structural member 101. This pressurized air cushion 503 also adds air pressure to the coolant within building frame 1, which is helpful for other reasons as will be discussed below.

At this point, the entire building frame of floors 1 through 10, vertical and horizontal (and diagonal as appropriate) will have been filled. Next, the second level (floors 11 through 20) pumps are turned on. Because of the gravitational grounding provided by the isolating plates 104, 105 and the check valves 401, the filling of the building frame 1 for floors 11 through 20 proceeds identically to what was described for floors 1 through 10. Once the building frame 1 for these floors are filled, then the third level pumps for floors 21 through 30 are activated, the building frame 1 for these floor is filled, and so on, until the entire building frame 1 has been filled. The sprinkler system storage containment 110 atop the roof may also be filed as well.

Let us now briefly discuss pressures. Referring to FIG. 4, a pressure detector 408 is situated proximate each coolant pump 106 and is tapped 409 via a pressure detection tap opening shown in FIG. 5 into vertical structural member 101 in order to detect the pressure of coolant within vertical structural member 101. This is of course sealed against coolant leakage. The illustrated connection line between pressure detector 408 and coolant pump 106 in FIG. 4 is meant to indicate that coolant pump 106 can be switched on and off in response to the pressures detected by pressure detector 408. Let us suppose again for illustration and estimation that at 1 p.s.i. per two feet of water height, a 100 foot vertical structural member 101 that is filled to the top with a water coolant will be subjected to 50 p.s.i. proximate its bottom. However, as noted above, each vertical structural member 101 is not filled to the very top. Rather, a pressurized air cushion 503 is allowed to accumulate in the top of each vertical structural member 101. This means that there will actually be slightly less pressure due to coolant 20 weight, but this will be counteracted by the pressure of the air cushion 503 at the top. So, when all is said an done, the pressure at the bottom of each vertical structural member 101 may be, for example, 60 p.s.i. The choice of what this pressure should be is actually an independent operational parameter of the system, so 60 p.s.i. is illustrative only and not limiting.

In this illustrative circumstance (bottom pressure chosen to be 60 p.s.i.), the pressurized air cushion 503 at the top of each column, subtracting off the coolant weight, will be approximately 60−50=10 p.s.i. and will thus add 10 p.s.i. of pressure to the coolant 10 flowing through each of the flow-limiting apertures 603. Thus, if the floors are ten feet apart thus 5 p.s.i. apart the coolant pressure through the flow-limiting aperture 603 on the bottom-floor horizontal structural member 102 would be 60 p.s.i. It would be 55 p.s.i. for the next floor up, then 50 p.s.i. for the third floor up, and so on, dropping to 15=5+10 p.s.i. for the final floor up. Thus, this pressurized air cushion 503 serves to add 10 p.s.i. of pressure for all floors but most importantly for the higher floors of a particular vertical structural member 101 where the extra coolant pressure is most valuable. Especially, it enables flow-limiting apertures 603 to be made smaller for a given flow rate, which is also very desirable for reasons to be discussed later. In light of the above, it is preferable for flow-limiting apertures 603 to be varied in dimension (e.g. diameter) to allow a predetermined flow rate regardless of the height of the associated horizontal structural member 102. Thus, for the 15 p.s.i. floor at the top, horizontal structural member 102 will be larger than it needs to be for the 60 p.s.i. floor at the bottom to ensure a single predetermined flow rate. Following this approach, flow-limiting apertures 603 preferably are successively larger moving from lower to higher floors for a given vertical structural member 101. Essentially, the flow-limiting aperture dimensions are preferably established so as to ensure substantial equivalence of predetermined flow rates between at least two horizontal structural members 102 attached at different heights to a single vertical structural member 101.

This is easily imagined by recalling the elementary-school science experiment of punching holes in a paper cup at varying heights and observing how the water shoots out more forcefully toward the bottom than toward the top, and in recognizing that if one desired to achieve a constant flow rate through each hole, then the upper holes would need to be cut larger than the lower holes in a manner that is readily amenable to mathematical calculation from known flow dynamic principals by someone of ordinary skill.

Let us suppose that it is pre-determined as an operational parameter that for a 100 foot vertical structural member 101 the pressurized air cushion 503 is to be 10 p.s.i., thus the bottom pressure is to be 60 p.s.i. Recall that for illustration, we are employing coolant pumps 106 which are rated at 125 p.s.i. Pressure detector 408 monitors the pressure proximate the bottom of a vertical structural member 101 not only during "charging," but indeed, at all times. When coolant pumps 106 are active, and once pressure detector 408 detects a 60 p.s.i. bottom pressure, this indicates that the associated vertical structural member 101 and all of its attached horizontal structural members 102 have been charged to the desired operating pressure, and so pressure detector 408 sends a signal to coolant pump 106 directing it to shut down. Note that at 125 p.s.i., coolant pump 106 has 125 60=65 p.s.i. to spare. Similarly, it might be predetermined that, say, 57 p.s.i. is the minimum pressure and that any drop below 57 p.s.i. should be addressed by pumping more coolant into vertical structural member 101. So, in effect, pressure detector 408 is used to observe two predetermined pressure limits a predetermined upper pressure threshold at which coolant pumps 106 are to be turned off, and a predetermined lower pressure threshold at which coolant pumps 106 are to be turned on.

By the time the entire building frame 1 is filled with coolant 20 to the desired pressure (e.g., 60 p.s.i.), all the coolant pumps 106 are automatically turned off because the predetermined upper pressure threshold has been reached. (Note, that manual overrides to turn coolant pumps 106 off and on from monitoring and control module 111 may also be provided within the scope of this disclosure.) In normal operation, all coolant pumps 106 run automatically, controlled by pressure detectors 408. By running the pumps at a suitable predetermined pressure, water loss due to leaks, maintenance or testing will be automatically replaced. When the pressure drops below a certain predetermined level in a given column, the pump at the level where the pressure drop is detected and all pumps along the same column at lower level are activated until adequate pressure is restored. This ensures that all pumps have a positive suction pressure, that is, that the pumps will push rather than pull water.

Now, we turn to operation during a fire. When a fire occurs, there are two distinct scenarios that need to be considered. First, there is the scenario where the only problem is a fire, and where the entire plumbing, pumping, framing, and related networks remain intact. Second, there is the more serious scenario where there is not only a fire, but where some portion of the framing and/or the plumbing has been destroyed by an explosion or a physical impact, as would have been the case at the World Trade Center on Sep. 11, 2001. We first look at the situation where the plumbing, pumping, framing, and related networks remain intact.

As soon as a fire moves to a location proximate one or more vertical structural members 101 and/or horizontal structural members 102 (or any other structural members containing coolant), the coolant residing inside those members will begin to heat up. Since the coolant is already under substantial pressure the variable that will change most rapidly and in which a change is most easily detected will be the temperature. This is where heat release valve 404 comes into play. Heat release valve 404 is a valve mounted to the horizontal structural members 102 (and possibly to vertical and other structural members as well) which detects the temperature of the coolant 20 in its vicinity. If heat release valve 404 detects that this temperature has reached a certain predetermined temperature threshold, which is preferably about 180° F., it will simply open up. Following the laws of physics, once heat release valve 404 has opened up, the more rapidly-moving coolant molecules will seek to escape, and the gaseous phase of coolant 20 (steam if coolant 20 comprises water) will begin to vent through heat release valve 404. While it is preferred that this predetermined temperature threshold be approximately 180° F., this predetermined temperature threshold can be set at approximately 170° or 160° or 150° or 140° or 130° and even as low as 120° F. Similarly, it can be set as high as approximately 185° or 190° or 200° or 210° or even 212° F. Indeed, it can be set up to the approximate boiling point of the coolant 20 at the particular elevation above sea level where the heat release valve 404 is situated. If a coolant 20 other than water is employed, the upper limit will be established by the point at which that coolant enters its gaseous phase. What is desired is to set heat release valve 404 to open up once a temperature has been reached which one could safely assume has been reached because of a fire, and not because of some other cause such as loss of air conditioning or ventilation on a hot, sunny day.

Because heat release valve 404 has two primary functions, one of which is to detect temperature and one of which is to open when a predetermined temperature threshold has been reached, one could within the scope of this disclosure and its associated claims utilize two separate but interconnected devices, one to detect temperature and the other to open when it is instructed to open in response to the temperature detection. Or, within the scope of this disclosure, a person situated proximate monitoring and control module 111 could view information indicating that the coolant 20 in a particular region has risen above a certain predetermined temperature threshold and send a manual signal opening up the nearby heat release valves 404. Indeed, this can be used as part of the alarm system to "report" a fire.

But the preferred embodiment employs a heat release valve 404 that both detects the temperature rise and opens automatically in response to the temperature rise, all as a self-contained unit. To the extent that heat release valve 404 operates automatically as a strictly self-contained mechanical unit which physically reacts to the temperature rise and opens up in response to this reaction, this is to be preferred, because there is no opportunity for the failures that could occur with an electronic unit, and/or with a unit that needs to communicate with some remote location before it opens and is thus vulnerable to a communications disruption. But again, a unitary mechanical device is preferred; other less-preferred situations are still regarded within the scope of this disclosure. One may employ more sophisticated heat release valves 404 which are programmable; that is, their predetermined temperature threshold can be varied at will, either by manually or electronically adjusting this predetermined temperature threshold, and by doing so either at the heat release valve 404 itself or from a remote location. But it acceptable also to use a fixed threshold device that will always open at a particular predetermined temperature threshold, for example, approximately 180° F. or any of the other predetermined temperature thresholds set forth above.

The emission of gaseous phase coolant serves to transfer heat away from the building frame 1 through the heat carried in the discharging gaseous coolant, achieving is a primary objective of the system. As noted earlier, optionally, this gaseous phase coolant can also be transported through optional gas phase coolant conduits 407 into interior locations in the building (that is, locations away from the frame structure ordinarily occupied by people, furniture, etc.), helping to extinguish the fires by crowding out oxygen and by adding a high moisture content to the area where the gaseous phase coolant is discharged, thereby performing double duty. Alternatively, or in addition, this can be vented entirely outside the building.

Of course, as gaseous phase coolant is discharged through heat release valves 404, this loss of coolant 20 will cause the pressure in the proximate vertical structural members 101 to drop. Following the earlier discussion, suppose the predetermined maximum pressure at the bottom of each vertical structural member 101 is set to 60 p.s.i. and the predetermined minimum pressure is set to 57 p.s.i. Once enough coolant 20 has been discharged through heat release valve 404 to bring the pressure detected by pressure detector 408 down to 57 p.s.i., the associated coolant pump 106, and importantly all coolant pumps 106 below it on the same column will be turned on, so that new, replacement coolant is be pumped into the vertical structural member 101 with the reduced pressure. Other coolant pumps 106 in other columns may also be turned on, which will begin to transport replacement coolant across the horizontal structural members 102 over to the deficient column. Additionally, once the fire department has arrived and gained access to monitoring and control module 111, the pressure detectors 408 may be overridden and all or selected ones of the coolant pumps 106 turned on so the maximum amount of their coolant 20 can be forced through the flow-limiting apertures 603 into hot and/or damaged sections of the building frame 1. Thus, a continuous flow of coolant is provided throughout the building frame 1, heat due to the fire is continuously exchanged out of (released from) the system through heat release valve 404, and this process is continued indefinitely until the fire is fully extinguished. Because building frame 1 is always maintained at or below the boiling point of coolant 20, 212° F. at sea level for water, the structural integrity of building frame 1 is maintained since 212° F. does not even come close to the temperatures at which the frame can be weakened by heat, and building collapses such as were witnessed at the World Trade Center can be completely avoided.

It is preferred, as described above, to turn the coolant pumps 106 on and off in response to pressure detection by pressure detectors 408 proximate coolant pumps 106. This is because bottom pressure is probably the best indicator of any coolant 20 losses in the system, and because by maintaining pressure detectors 408 proximate coolant pumps 106 there is no need for communication over a wider area which might be cut in an emergency. As noted, manual control from monitoring and control module 111 is also desirable. It is also possible within the scope of this disclosure to turn the coolant pumps 106 on and off in response to heat release valve 404 in which case coolant 20 would be pumped as soon as it has been detected that the coolant 20 temperature has risen to abnormal levels (more broadly, heat sensitivity rather than pressure sensitivity). It is also possible within the scope of this disclosure to turn the coolant pumps 106 on and off in response to a float valve or similar detector proximate the top of the pertinent vertical structural member 101 which would turn on coolant pumps 106 in response the detecting that the physical level of coolant 20 in vertical structural member 101 has dropped below a predetermined level. To the extent that a hard-wired communications link is needed, it is preferable to utilize approaches that maintain detection as close as possible to the pumps, so that the possibility of a disruption in communications is avoided. It is to be noted also that for redundancy, one or more of these approaches can be combined. Thus, a coolant pump 106 may be switched on in response to detecting a drop in pressure, or detecting a rise in temperature, or detecting a drop in coolant 20 level below a certain height, or manually from monitoring and control module 111 (that latter of which will likely be the mode of operation once the fire department has arrived on scene), or any other similar approach. A coolant pump 106 may also be switched off by any of these or other similar approaches, when the coolant has been restored in satisfactory measure.

It is also noted that while air vent and coolant retention assemblies 403 and heat release valves 404 are illustrated as being two separate components, that it would be feasible to combine these into a single unitary component were such a component to be developed. Such a single component would need, in a single device, to combine means for 1) venting ordinary air under pressure, 2) closing down once air is vented and coolant 20 occupies the space from which the air had been vented 3) detecting a rise in temperature and 4) re-opening to vent gaseous phase coolant for heat release in response to detecting such a rise in temperature. This is the special circumstance referred to earlier, wherein air vent aperture 604 and heat release aperture 605 can be merged into a single aperture.

Finally, it is observed that while heat release valves 404 are illustrated at the proximate the ends of horizontal structural members 102, they can be placed at other locations along horizontal structural members 102 as well, without limitation. They can be placed on the vertical structural members 101 if desired, also within the scope of this disclosure. Because heat release valve 404 provide the means by which heat is removed from hot framing, the more frequent (closer together) use of heat release valves 404 enables heat removal on a more localized basis.

We turn now to examine the more serious disaster scenario where there is not only a fire, but where some portion of the framing and/or the plumbing has been destroyed by an explosion or a physical impact. In this circumstance, the system operates in the same manner discussed previously, except now, the flow-limiting apertures 603 come prominently into play.

If the entire building frame 1 were to remain fully intact throughout a disaster, then flow-limiting apertures 603 would not be necessary. The purpose of flow-limiting aperture 603 is to prevent coolant 20 from suddenly, instantaneously draining out of the building frame 1 if one or more of the vertical structural members 101 or horizontal structural members 102 become severed or ruptured. In particular, it is important to carefully choose the dimensions (e.g., the diameter) of flow-limiting aperture 603 such that if a rupture does take place, the emission of coolant 20 out of the frame is sufficiently limited by flow-limiting aperture 603 so that coolant pumps 106 can more than replace the draining coolant. More precisely, flow-limiting apertures 603 must be large enough so that coolant 20 can be pumped into and through horizontal structural members 102 under the available pressures fast enough to replace all hot coolant that is emitted through heat release valve 404, and at the same time small enough so that in the event of a rupture, the emission (draining) of coolant 20 through the flow-limiting apertures 603 proximate the rupture is slow enough to not outpace replacement coolant pumped back into and through horizontal structural members 102.

Returning to FIG. 6, it is to be observed that the flow-limiting mid-plates 602 serve to isolate rupture damage even within a single horizontal structural member 102. Thus, for example, if the middle third of horizontal structural member 102 in FIG. 6 were to become fully severed, coolant 20 would of course flow at a limited rate through the flow-limiting apertures 603 of the flow-limiting mid-plates 602 out of the system. But, if these flow-limiting apertures 603 are sufficiently small, the new coolant can be pumped in to the left third and the right third, under pressure, at a sufficient rate to replace lost coolant lost through the mid-section rupture. The placement of the flow-limiting apertures 603 toward the top of flow-limiting mid-plates 602 also ensures that most coolant 20 will remain in the intact regions of horizontal structural member 102, because even if no replacement coolant 20 were to be pumped in, existing coolant 20 would stop its emission (spillage) once it had dropped to the level of the flow-limiting apertures 603.

Flow-limiting mid-plates 602 are preferred, but optional. The flow-limiting apertures 603 at the ends of the horizontal structural members 102, on the other hand, are vital to protect the vertical structural members 101 of the building frame 1. (Recall that for a surface butt weld, flow-limiting apertures 603 comprises an aperture through a side face of vertical structural member 101.) If an entire horizontal structural member 102 were to rupture, the flow-limiting apertures 603 on the column are again made small enough so that any coolant 20 that is emitted via flow-limiting apertures 603 is more than compensated by replacement coolant 20 being pumped in from all other coolant pumps 106 which are still intact. As noted earlier, for any given vertical structural member 101, the pressures on the lower flow-limiting apertures 603 are greater than the pressures on the upper flow-limiting apertures 603, hence the upper flow-limiting apertures 603 should be made larger, with the goal being that the rate of flow of coolant be substantially the same through each flow-limiting aperture 603 regardless of its height on a given vertical structural member 101.

So, let us presume that in an absolute worst case in the context of the illustration under consideration, all ten of the horizontal structural members 102 on a given vertical structural member 101 have been ruptured. So, coolant now begins to flow freely out of the vertical structural member 101, emitted through ten distinct flow-limiting apertures 603. A rough, worst-case calculation would suggest that the coolant pumps 106 need therefore to be able pump in replacement coolant at ten time the rate at which coolant flows out of any single flow-limiting apertures 603. However, the situation is not quite so extreme, because the overall network of vertical structural members 101 and horizontal structural members 102 allows replacement coolant to be drawn from other regions of the building frame 1 which remain undamaged. An illustration is helpful.

Referring to FIG. 1, let us suppose that during a fire and explosion, the corner vertical structural member designated 111 is ruptured and its pump system destroyed the floors (31–40) on that level and above (41+) the rupture will be affected. Water to the floors below the rupture (30–) will still be supplied to the corner column comprising the damaged vertical structural member 111, up to the damaged level, by that column's own lower coolant pumps 106. That is, the floors below are unaffected. Water to the horizontal structural members 102 for floors (31–40) in the damaged level normally fed from the corner column comprising the damaged vertical structural member 111 is now alternatively fed from all other columns in building frame 1 still under pressure from their own pump systems. Most immediately, coolant will flow toward the column comprising the damaged vertical structural member 111 through the horizontal structural members designated 112 and 113 (remember that there are ten each of these per vertical structural member 111 in this illustration), and the horizontal structural members designated 112 and 113 will in turn be fed coolant converging from all other columns in the building frame 1, which is apparent simply by looking at the flow paths through the horizontal structural members 102 in FIG. 1. On the other hand, the vertical structural member(s) 101 above the damaged vertical structural member 111 in the same column which comprises the damaged structural member 111 won't lose any of their coolant to the damaged structural member 111, because of the isolating plate in the next higher section (floors 41–50), designated as 114, as well as the check valve proximate 114. These together will prevent any downward flow into the ruptured section, and will continue to cool the vertical structural members 101 and horizontal structural members 102 above the rupture.

Let us consider a second scenario where the horizontal structural member designated as 115 has ruptured, or more precisely, where several of the horizontal structural members for floors 31–40 have ruptured. Here, as discussed earlier, the flow-limiting apertures 603 for the adjacent columns will limit coolant loss from these columns, and that lost coolant will be made up by their own pump systems extra capacity, as well as by coolant flowing through the building frame 1 from other columns and operative coolant pumps 106.

Various other scenarios can be considered, but in all cases, the entire building frame 1 establishes a flow network so that whenever there is a rupture, isolating plates 104, 105, check valves 401, flow limiting end-plates 601, flow-limiting mid-plates 602, and flow-limiting apertures 603 all serve to isolate the damaged sections of the building frame 1. Thus, even in the event of a rupture somewhere in building frame 1, coolant 20 continues to flow unabated to all sections of building frame 1 except for those localized sections that have been ruptured. In essence, these elements establish isolation boundaries so that any damaged frame section or area can be kept from jeopardizing undamaged frame members or the coolant supply system in a similar manner to what was set forth in the above scenarios.

It can be seen from this, that the closer the isolating plates 104, 105 and check valves 401 are placed to one another (i.e., the shorter the vertical structural members 101), and the more flow-limiting apertures 603 and flow limiting end-plates 601 and flow-limiting mid-plates 602 are employed, the more it becomes possible to localize damage in the event of a frame rupture. Cost, of course, becomes the limiting factor.

Let us now summarize the many benefits arrived at by this system, which include the primary benefit of avoiding catastrophic damage to the building frame, as well as a number of secondary benefits.

As long as a frame member has some water left in it, any heat the steel receives from the fire will be conducted rapidly to the cooler water and therefore not raise the steel's temperature appreciably. More heat transferred into coolant results in more coolant being boiled off since the coolant, if water, can't exceed its boiling point of 212° F. at sea level. Therefore, for a 1500° F. fire on the outside of the frame, the temperature will remain at 212° F. on the inside, and the "average" steel temperature is only 856° F., which is well below the weakening temperature of steel. Each horizontal structural member 102 can obtain its replacement coolant from either end. So loss of supply to one end due to damage is no problem. Flow limiting end-plates 601, and optional flow-limiting mid-plates 602, all with flow-limiting apertures 603, limit coolant loss only to a damaged sections. Vertical structural members 101 can get their replacement coolant through numerous interconnected horizontal structural members 102 when their normal supply is interrupted.

Excess coolant loss through a damaged frame member will be minimized by adjacent flow limiting end-plates 601, and optional flow-limiting mid-plates 602 with flow-limiting apertures 603 restricting the outflow to not much more than is needed to make up boiled-away coolant.

Eliminating the need to provide insulation on the building frame 1 results in more floor space and no environmental concerns over insulation's friable or vaporous hazards in normal or emergency use, or its manufacture or installation. Also, eliminating the need to provide insulation on the building frame 1 removes a significant cost. Of course, some of this cost saving will go into the pumps, etc., needed to supply coolant, but preliminary cost estimates suggest that there is a net overall cost savings from using the invention disclosed herein rather than conventional insulation to protect the frame that may amount to about 5%.

Most thermal protection coatings are factory applied, therefore subject to weather, transportation, joint damage and on the job time loss for repairs. Further, earthquakes, temperature changes and wind can crack welds, loosen joints and fatigue steel. These failures are more obvious to visual inspections or testing procedures when not covered with insulation and when backed by pressurized water. Indeed, the same pressure detectors 408 which detect coolant pressure can help to identify and isolate problems with the building frame 1. Exterior frame temperature and weather protection may not needed, therefore avoiding the use of thick, bulky insulation on outside visible members.

Buildings lean away from the sun's heat and return on its loss due to thermal expansion on the side exposed to the sun. This system will lessen this action by absorbing and transferring the heat more slowly and evenly because the interior water will have to be heated as well as the steel. This results in longer building life by reducing the strain on the frame and welded joints.

Insurance premiums are based on potential loss of life and property. If a building's frame can survive a fire longer or even indefinitely, both personal and property loss will be less, insurance premiums can be reduced, and insurance losses can be limited to interior contents and non-framing structure.

No new engineering or construction techniques will have to be developed or taught to employ this invention. Welded tubular frame construction will be exactly the same whether one employs punch or butt-welded assembly. Factory-installed thermal insulation, now not needed, will be replaced by factory installation of flow limiting end-plates 601, flow-limiting mid-plates 602, air vent apertures 604 and heat release apertures 605 in the horizontal structural members 102, and isolating plates 104, 105, coolant injection conduits 402 and pressure detector taps 409 in the vertical structural members 101. Electrical and pipefitting work also require nothing beyond standard operations.

Coolant-filled tubular frame members may be made thinner due to their natural configuration and thermally-enhanced strength over I beams. Pound for pound box iron beams are stronger the "I" beams. Building frames are designed stronger than needed to carry the necessary weight, so they will have enough reserve strength to do so when hot. Concrete is a very poor option, since it can't be thermally protected as well as tubular steel. Concrete's limited amount of steel being under great mechanical stress is more subject to failure from the fire's heat. Concrete's cracking and spalling tendency from heat further exposes the reinforcement steel to heat. Concrete requires a greater volume and weight equal strength to steel, valuable floor area and frame strength are lost. Steel erection time and cost is also lower than for concrete.

Buildings less than approximately 200 feet tall only need building frames 1 filled from ground level by the potable water supply with no pump system. A 200 foot head of water is equal to approximately 100 p.s.i., which is the pressure of most public water supplies.

As noted, gaseous phase coolant, e.g., steam for a water coolant, generated by boiled-off coolant through heat release valves 404 or controlled loss through flow-limiting apertures 603 feeding into frame ruptures, will cool the fire and displace some of the fire's oxygen supply. This is the same tactic firemen use with spray nozzles in closed in-fire spaces.

Under extreme conditions, only 36 g.p.m. will be boiled out of a 650 gallon 1'×2'×50' box beam (horizontal structural member 102). At that rate it will take 18 minutes before the steel's temperature starts rising above 212° F. Of course there will be indefinitely more time to provide replacement coolant as preexisting coolant is boiled out. Flow-limiting apertures 603 may permit about a 70–80 g.p.m. outflow. Coolant pumps 106 rated at 125 p.s.i. and 200 g.p.m. should suffice under even the most extreme conditions, because any shortfall in coolant via any one pump will be more than compensated by coolant flowing from unaffected regions of the frame. Thus, even if all ten horizontal structural members 102 on one side of a given vertical structural member 101 were to be severed, creating a situation where 700–800 g.p.m. are needed to outpace the emission of coolant through ten flow-limiting apertures 603, the combined contributions of four or more other pumps will serve to provide the necessary coolant through the overall building frame 1 network. The fire department could also put all pumps under manual control, as well as add their own coolant supply, which further supplements the coolant supply.

No flow limiting end-plate 601 or flow-limiting mid-plates 602 will ever have excess differential across it, because the building is divided into levels by isolating plates 104, 105 at the bottom of each vertical structural member 101 in all of the vertical columns. That is, water pressures are limited within precisely delineated sections of the building frame 1. Lower pressures ensure less water loss through a frame's rupture.

As discussed, coolant pumps 106, coolant conduits 107, and other components (e.g., wiring, pressure detectors 408) are protected from heat damage by attaching them closely to their respective vertical structural member 101 and enclosing them on three sides with fireproof insulating shield 405. The fourth side is protected and cooled by the coolant inside vertical structural member 101 itself. Complete failure of one or more vertical structural members 101 and their supporting cooling components is compensated by the still-intact horizontal structural members 102 being back-fed from good columns and their coolant supplies and coolant pumps 106.

Air and steam vapor blocks are prevented or cleared normally by air vent and coolant retention assemblies 403. If an air vent and coolant retention assemblies 403 fails to open under emergency conditions, the proximate heat release valve 404 will pop open until the steam or temperature has abated. Damaged or failed heat release valves 404 are of no concern because adjacent heat release valves 404 through the flow limiting end-plates 601 and optional flow-limiting mid-plates 602 will provide the same function. Air vent and coolant retention assemblies 403 and heat release valves 404 aren't subject to failure by heat. All are preferably stainless steel rated at 1000° F. and are of course in contact with the cooler frame member they protect. Any heat the valves absorb from the fire will be conducted directly to the frame and then the interior water, which is no hotter than 212° F.

Corrosion, leaks, freezing and oxidation may all be controlled with additives to the coolant 20. Public water is generally free from potential trouble-causing agents. Only a few buildings due to their design or location would need freeze protection, which once provided, because there is no water circulation, would always be there except if lost in a fire.

The coolant weight is of little concern. Water is only one-seventh by volume the weight of steel. The water in the vertical structural members 101 rests directly on the building's foundation. A typical horizontal structural member 102 0.1'×1.0'×2.0'×50' would weigh 14,700 pounds, while the water inside it weighs only 4860 pounds. Indeed, the relatively small increased mass the cooling water adds to a building will make it better able to withstand an airplane strike.

The supply of coolant 20 to the building frame 1 under fire conditions is assured by several supplies: The public water supply 108, coolant from the firs department via external hose connections 109, roof storage containment 110, and coolant that was initially in the system, all provide an ample supply of coolant for emergency. As noted, all of the flow limiting end-plates 601 and optional flow-limiting mid-plates 602, flow-limiting apertures 603, air vent and coolant retention assemblies 403 and heat release valves 404 are near the top of their horizontal structural member 102 to ensure the horizontal structural members 102 are full initially and stay full during a fire.

In a typical room of 10'×50'×50' there is enough initial water in the frame around the room to absorb the heat from 550 gallons of airplane fuel. One gallon of oil or plastic will generate 140,000 BTUs of heat. Wood and paper have about 80% of the heat value of oil per pound. Of course heat from much more fuel, perhaps any amount, will be absorbed by pumped in replacement coolant.

Building sway caused by an earthquake won't be exaggerated by the water in the building frame 1. Aside from the pressurized air cushion 503 which is desirable, there are no voids left inside building frame 1 for the coolant 20 to slosh back and forth. The flow limiting end-plates 601 and optional flow-limiting mid-plates 602 in the horizontal structural member 102 also act as baffle plates.

As noted earlier, the more isolating plates 104, 105, flow limiting end-plates 601 and optional flow-limiting mid-plates 602, air vent and coolant retention assemblies 403 and heat release valves 404 in the horizontal structural members 102, and the more water level divisions (fewer floors per isolating plate 104, 105) created by sealed isolating plates 104, 105 in the columns, and the more coolant pumps 106, pump-cooled columns, and auxiliary water supplies there are, the greater the flexibility, and the more reliable and functional the fire and heat protection will be.

This disclosure of course can be applied to other types of construction besides tall building construction, within the scope of this disclosure and its associated claims. Lighter frame members typically used in car show rooms, warehouses, and similar buildings typically twist, pull apart and fail mechanically before they are hot enough to fail thermally. This can happen so suddenly that firemen won't risk their lives by entering such a building. The described system also prevents this type of failure.

While this disclosure has referred to the frame members being fabricated from frame member materials comprising steel or iron or a similar material, it is to be understood that this is not limiting. Other metallic materials used in framing fall equally within the scope of this disclosure and its associated claims. This includes all known materials used in building framing as well as any new materials, composites, etc., that may be developed in the future for use in building framing.

While only certain preferred features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A building frame protected from fire and heat to avoid catastrophic collapse, comprising:

coolant filling means for substantially filling said building frame with a coolant; and a plurality of coolant emission valves in various locations of said building frame for emitting said coolant from said building frame into the building responsive to said coolant being heated from a fire.

2. The building frame of claim 1, further comprising: coolant replacement means for replacing the emitted coolant with replacement coolant.

3. The building frame of claim 1, further comprising: flow-limiting means for limiting a flow rate of said coolant emitted from said frame when a portion of said frame is ruptured.

4. A system for protecting a building frame from fire and heat to avoid catastrophic collapse, comprising: coolant filling means for substantially filling said building frame with a coolant; and heat release emission means for emitting said coolant from said building frame when said coolant is heated from a fire.

5. The system of claim 4, further comprising: coolant replacement means for replacing the emitted coolant with replacement coolant.

6. The system of claim 4, further comprising: flow-limiting means for limiting a flow rate of said coolant emitted from said frame when a portion of said frame is ruptured.

7. A system for protecting a building frame from fire and heat to avoid catastrophic collapse, comprising: a plurality of vertical structural members comprising substantially vacant interiors thereof; a plurality of horizontal structural members comprising substantially vacant interiors thereof; a plurality of attachments between ends of said horizontal structural members and side faces of said vertical structural members enabling a coolant to flow between said interiors of said vertical structural members and said interiors of said horizontal structural members; a plurality of coolant pumps for pumping said coolant into said vertical structural members; and a plurality of heat release valves for emitting said coolant from said interiors of said vertical structural members and said interiors of said horizontal structural members when a temperature of said coolant reaches a predetermined temperature threshold.

8. The system of claim 7, further comprising: a plurality of flow-limiting apertures limiting a flow rate of said coolant emitted from said interiors of said vertical structural members and said interiors of said horizontal structural members when at least one of said structural members is ruptured.

9. The system of claim 8, said flow-limiting apertures comprising: flow-limiting aperture dimensions established to ensure substantial equivalence of flow rates between at least two horizontal structural members attached at different heights to a single vertical structural member.

10. The system of claim 7, further comprising: watertight seals between said horizontal structural members and said vertical structural members.

11. The system of claim 7, further comprising: a plurality of air vent and coolant retention assemblies for bleeding off air, and blocking said coolant against exiting, from said horizontal structural members.

12. The system of claim 7, said horizontal structural members further comprising at least some of said heat release valves.

13. The system of claim 7, said vertical structural members further comprising at least some of said heat release valves.

14. The system of claim 7, further comprising: a plurality of pressure detectors detecting pressures of said coolant within said vertical structural members; and a plurality of switches for activating at least one of said coolant pumps when at least one of the detected pressures drops below a predetermined lower pressure threshold.

15. The system of claim 7, further comprising: a plurality of switches for activating said coolant pumps to replace said coolant emitted through said heat release valves.

16. The system of claim 8, further comprising: a plurality of switches for activating said coolant pumps to replace said coolant emitted through said flow-limiting apertures.

17. The system of claim 7, further comprising: a pressurized air cushion maintained proximate an upper end of at least one of said vertical structural members.

18. The system of claim 7, further comprising: a plurality of isolating plates preventing said coolant from flowing downward from any one vertical structural member to the next-lower vertical structural member.

19. The system of claim 18, further comprising: watertight seals between said isolating plates and said vertical structural members.

20. The system of claim 18, further comprising: a plurality of check valves preventing said coolant that has been pumped upward by any one of said coolant pumps from flowing downward toward said any one of said coolant pumps.

21. The system of claim 7, further comprising: a monitoring and control module for monitoring said coolant in said vertical and horizontal structural members and manually controlling operation of said coolant pumps.

22. The system of claim 7, further comprising: a public water supply supplying at least some said coolant.

23. The system of claim 7, further comprising: at least one external hose connection supplying at least some of said coolant.

24. The system of claim 7, further comprising: at least one roof storage containment receiving said coolant via said coolant pumps and storing said coolant for use by a fire sprinkler system of said building.

25. The system of claim 7, further comprising: a plurality of gas phase coolant conduits transporting said coolant emitted through said heat release valves to interior locations in said building.

26. The system of claim 7, further comprising: a plurality of gas phase coolant conduits transporting said coolant emitted through said heat release valves to locations outside said building.

27. A method for protecting a building frame from fire and heat to avoid catastrophic collapse, comprising the steps of:

substantially filling said building frame with a coolant; and emitting said coolant from various locations of said building frame into the building responsive to said coolant being heated from a fire.

28. The method of claim 27, further comprising the step of: replacing the emitted coolant with replacement coolant.

29. The method of claim 27, further comprising: limiting a flow rate of said coolant emitted from said frame when a portion of said frame is ruptured.

30. A method for protecting a building frame from fire and heat to avoid catastrophic collapse, comprising the steps of: attaching ends of horizontal structural members with side faces of vertical structural members, said vertical structural members comprising substantially vacant interiors thereof, and said horizontal structural members comprising substantially vacant interiors thereof; pumping a coolant into said vertical structural members; flowing said coolant between said interiors of said vertical structural members and said interiors of said horizontal structural members; and emitting said coolant from said interiors of said vertical structural members and said interiors of said horizontal structural members when a temperature of said coolant reaches a predetermined temperature threshold.

31. The method of claim 30, further comprising the step of: limiting a flow rate of said coolant emitted from said interiors of said vertical structural members and said interiors of said horizontal structural members when at least one of said structural members is ruptured, using flow-limiting apertures.

32. The method of claim 31, said flow-limiting apertures comprising the step of: establishing dimensions of said flow-limiting aperture to ensure substantial equivalence of flow rates between at least two horizontal structural members attached at different heights to a single vertical structural member.

33. The method of claim 30, further comprising the step of: watertight sealing said horizontal structural members with said vertical structural members.

34. The method of claim 30, further comprising the step of: bleeding off air, and blocking said coolant against exiting, from said horizontal structural members.

35. The method of claim 30, further comprising the step of emitting at least some of said coolant through said horizontal structural members.

36. The method of claim 30, further comprising the step of emitting at least some of said coolant through said vertical structural members.

37. The method of claim 30, further comprising the steps of: detecting pressures of said coolant within said vertical structural members; and activating the coolant pumping when at least one of the detected pressures drops below a predetermined lower pressure threshold.

38. The method of claim 30, further comprising the step of: activating the coolant pumping to replace said coolant emitted when said temperature of said coolant reaches said predetermined temperature threshold.

39. The method of claim 31, further comprising the step of: activating the coolant pumping to replace said coolant emitted through said flow-limiting apertures.

40. The method of claim 30, further comprising: a pressurized air cushion maintained proximate an upper, end of at least one of said vertical structural members.

41. The method of claim 30, further comprising the step of: preventing said coolant from flowing downward from any one vertical structural member to the next-lower vertical structural member, using isolating plates.

42. The method of claim 41, further comprising the step of: watertight sealing said isolating plates with said vertical structural members.

43. The method of claim 41, further comprising the step of: preventing said coolant that has been pumped upward from flowing downward after is has been pumped upward.

44. The method of claim 30, further comprising the steps of: monitoring said coolant in said vertical and horizontal structural members; and manually controlling operation of the coolant pumping.

45. The method of claim 30, further comprising the step of: supplying at least some said coolant using a public water supply.

46. The method of claim 30, further comprising the step of: supplying at least some of said coolant using at least one external hose connection.

47. The method of claim 30, further comprising the step of: receiving said coolant from said coolant pumping into at least one roof storage containment; and storing said coolant in said at least one roof storage containment, for use by a fire sprinkler system of said building.

48. The method of claim 30, further comprising the step of: transporting said coolant emitted through said heat release valves to interior locations in said building.

49. The method of claim 30, further comprising the step of: transporting said coolant emitted through said heat release valves to locations outside said building.

* * * * *